US005853206A

United States Patent [19]

Kleefeldt et al.

[11] Patent Number: 5,853,206

[45] Date of Patent: Dec. 29, 1998

[54] POWER-ACTUATED MOTOR-VEHICLE DOOR LATCH

[75] Inventors: Frank Kleefeldt, Heiligenhaus; Peter Bartel, Hattingen; Horst Brackmann; Theodor Menke, both of Velbert, all of Germany

[73] Assignee: Kiekert Aktiengesellschaft, Heiligenhaus, Germany

[21] Appl. No.: 771,800

[22] Filed: Dec. 20, 1996

Related U.S. Application Data

[62] Division of Ser. No. 520,534, Aug. 28, 1995, Pat. No. 5,667,263.

[30] Foreign Application Priority Data

Sep. 1, 1994 [DE] Germany ..... 44 31 147.8
Mar. 4, 1995 [EP] European Pat. Off. ..... 95103123

[51] Int. Cl.[6] ..... E05C 3/06

[52] U.S. Cl. ..... 292/201; 292/DIG. 23

[58] Field of Search ..... 292/201, 336.3, 292/DIG. 23, DIG. 3, 216; 70/279, 264

[56] References Cited

U.S. PATENT DOCUMENTS

| | | | |
|---|---|---|---|
| 4,135,377 | 1/1979 | Kleefeldt et al. | 70/279 X |
| 4,518,181 | 5/1985 | Yamada | 292/201 |
| 4,904,006 | 2/1990 | Hayakawa et al. | 292/201 X |
| 4,926,707 | 5/1990 | Yamada | 292/201 X |
| 4,932,277 | 6/1990 | Beaux | 292/201 X |
| 4,932,690 | 6/1990 | Kleefeldt et al. | 292/201 X |
| 4,934,746 | 6/1990 | Yamada | 292/201 |
| 5,419,597 | 5/1995 | Brackmann et al. | 292/201 |
| 5,476,294 | 12/1995 | Menke | 292/201 X |
| 5,538,298 | 7/1996 | Ikeda | 292/201 |
| 5,615,564 | 4/1997 | Inoue | 292/201 |
| 5,634,677 | 6/1997 | Buscher et al. | 292/216 |

*Primary Examiner*—Rodney M. Lindsey
*Attorney, Agent, or Firm*—Herbert Dubno; Andrew Wilford

[57] ABSTRACT

A motor-vehicle door latch has a housing and a locking mechanism in the housing having an inside locking lever displaceable between a locked position in which the latch is locked and an unlocked position in which the latch is unlocked. An output element rotatable about an axis on the housing is formed with a spiral main groove having a pair of ends and with a transverse connecting groove extending between the ends. A pin mounted directly on the locking lever rides directly in the spiral groove. A reversible electric motor can rotate the output element so that the pin travels between the ends of the spiral groove for displacing the locking lever into the locked position when the pin engages one of the groove ends and for displacing the locking lever into the unlocked position when the pin engages the other of the groove ends. A locking element connected to the inside locking lever displaces same manually between its positions with movement of the pin along the connecting groove between the spiral groove ends.

1 Claim, 3 Drawing Sheets

POWER-ACTUATED MOTOR-VEHICLE DOOR LATCH

CROSS REFERENCE TO RELATED APPLICATION

This application is a division of application Ser. No. 08/520,534 filed 28 Aug., 1995 now U.S. Pat. No. 5,667,263 with a claim to the priority of German application P 44 31 147.8 filed 1 Sep., 1994 and European 95 103 123.6 filed 4 Mar., 1995.

FIELD OF THE INVENTION

The present invention relates to a motor-vehicle door latch. More particularly this invention concerns such a latch that can be operated remotely, that is that has its own actuator or motor for power actuation.

BACKGROUND OF THE INVENTION

A motor-vehicle door latch normally has a housing, a lock fork on the housing engageable with a door bolt and pivotable between a holding position engaged around the bolt and retaining it on the housing and a freeing position permitting the door bolt to move into and out of the housing, and a release pawl engageable with the fork and displaceable between a latched position retaining the fork in the holding position and an unlatched position unengageable with the fork and permitting the fork to move into the freeing position. An actuating mechanism is movable between an actuated position and an unactuated position and normally has an inside and an outside actuating lever connected to respective door handles. A coupling part is displaceable on the housing between a coupling position connecting the actuating mechanism to the release pawl for displacement of the release pawl into the unlatched position on displacement of the actuating mechanism into the actuated position and a decoupling position for disconnecting the actuating mechanism from the release pawl. Thus in the decoupling position operation of the actuating mechanism does not affect the release pawl. A central locking element is displaceable on the housing between locked and unlocked positions and is connected via a locking mechanism normally also operable by at least an inside locking element with the coupling part for displacing the coupling part into the decoupling position on displacement of the central locking element into the locked position and for displacing the coupling part into the coupling position on displacement of the central locking element into the unlocked position.

In a common system the power actuation is effected by a reversible electric motor. In addition there is of course the possibility of a manual locking and unlocking of the door that is particularly useful if the power fails or the power locking is otherwise not operational. To this end the standard actuation element is a spiral groove in which engages a pin so that the pin is cammed out and in between the locked and unlocked positions, and an additional crosswise groove connects the ends of the spiral groove to allow this manual actuation.

The central locking system described in EP 0,059,658 of J. P. Noel uses a contact lever for controlling and switching the electrical motor of the latch. This contact lever has a pin riding in the cam and represents a cumbersome and expensive system, since the contact lever also forms the input element for the described manual actuation.

OBJECTS OF THE INVENTION

It is therefore an object of the present invention to provide an improved power-actuated motor-vehicle door latch.

Another object is the provision of such an improved power-actuated motor-vehicle door latch which overcomes the above-given disadvantages, that is which is substantially simpler than the prior-art systems.

SUMMARY OF THE INVENTION

A motor-vehicle door latch has according to the invention a housing and a locking mechanism in the housing having an inside locking lever displaceable between a locked position in which the latch is locked and an unlocked position in which the latch is unlocked. An output element rotatable about an axis on the housing is formed with a spiral main groove having a pair of ends and with a transverse connecting groove extending between the ends. A pin mounted directly on the locking lever rides directly in the spiral groove. A reversible electric motor can rotate the output element so that the pin travels between the ends of the spiral groove for displacing the locking lever into the locked position when the pin engages one of the groove ends and for displacing the locking lever into the unlocked position when the pin engages the other of the groove ends. A locking element connected to the inside locking lever displaces same manually between its positions with movement of the pin along the connecting groove between the spiral groove ends.

Thus in the instant invention the already provided inside locking lever can be used for the described manual actuation. No contact lever is needed.

The output element can be a flat disk lying in a plane generally perpendicular to the axis with the grooves open axially and the connecting groove extending generally radially of the axis. Alternately the output element is a cylindrical body generally centered on the axis with the grooves open radially outward and the connecting groove extending generally parallel to the axis.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
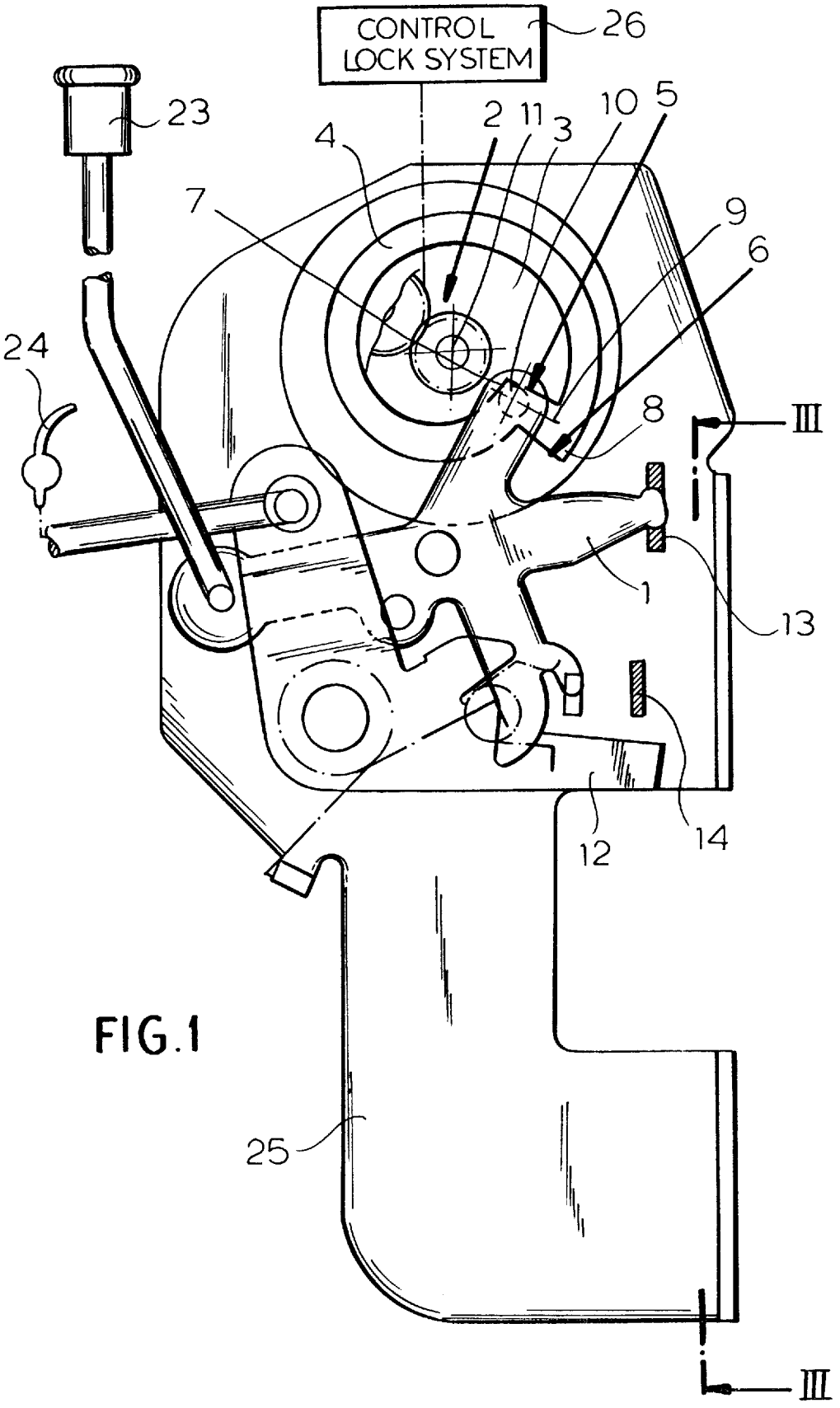
FIG. 1 is a partly diagrammatic vertical section through a door latch according to the invention.

As seen in FIG. 1 a motor-vehicle door latch has a housing 25 on which is pivoted a locking lever 1 that can be moved manually by an inside door-locking button 23 in the manner well known in the art to lock and unlock the door. An electric-motor drive 2 that is part of a central lock system 26 can rotate a flat metal disk 3 about an axis 11 on the housing 25. This disk 3 is formed with an axially open one-turn spiral groove 4 having an inner end 7 forming an abutment 5 and an outer end 8 forming an abutment 6, and with a radially extending connecting groove 9 extending between the ends 7 and 8.

The locking lever 1 carries a pin 10 that rides in the grooves 4 and 9. When the pin 10 is engaged with the abutment 5 the latch is unlocked, and when it engages the abutment 6 the latch is locked. Thus the motor drive 2 can move the latch between the locked and unlocked position by camming the pin 10 radially inward and outward, or the lever 23 can act directly on the lever 1 to lock or unlock the latch when the pin 10 is in either of the spiral ends 7 or 8 by displacing it radially along the groove 9. The system 26 monitors the current consumption of the motor drive 2 to disconnect it when this consumption exceeds a predetermined level indicating that the pin 10 is blocking further angular movement of the disk 3.

Figure 2:
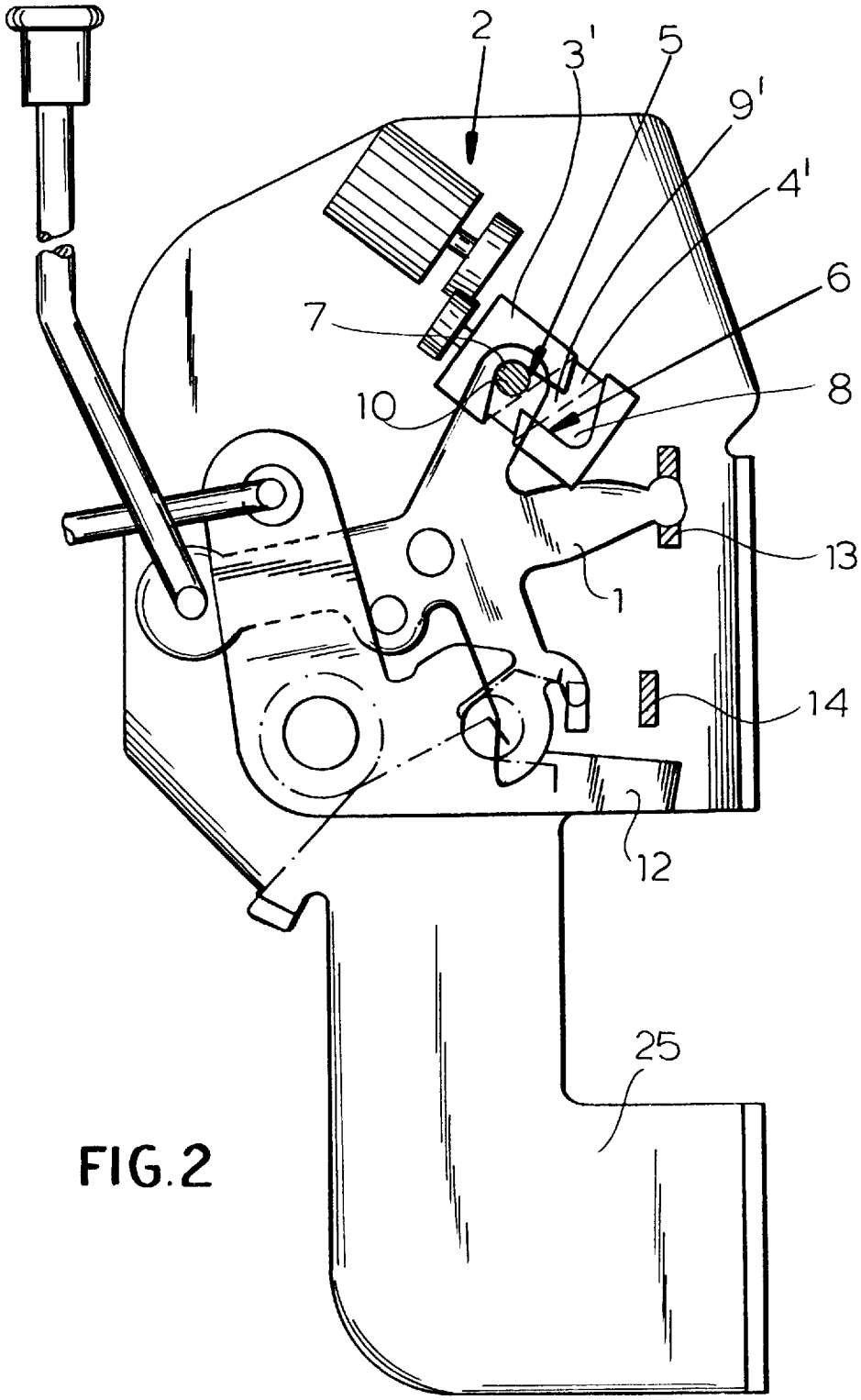
FIG. 2 is a view like FIG. 1 of an alternative arrangement of the latch in accordance with the invention.

FIG. 2 shows a similar arrangement where instead of a flat disk 3 there is a drum 3' formed with a radially outwardly open spiral groove 4' having an axially extending connecting groove 9'. This system operates identically to that of FIG. 1 and identical reference numerals are assigned to functionally identical structure.

Figure 3:
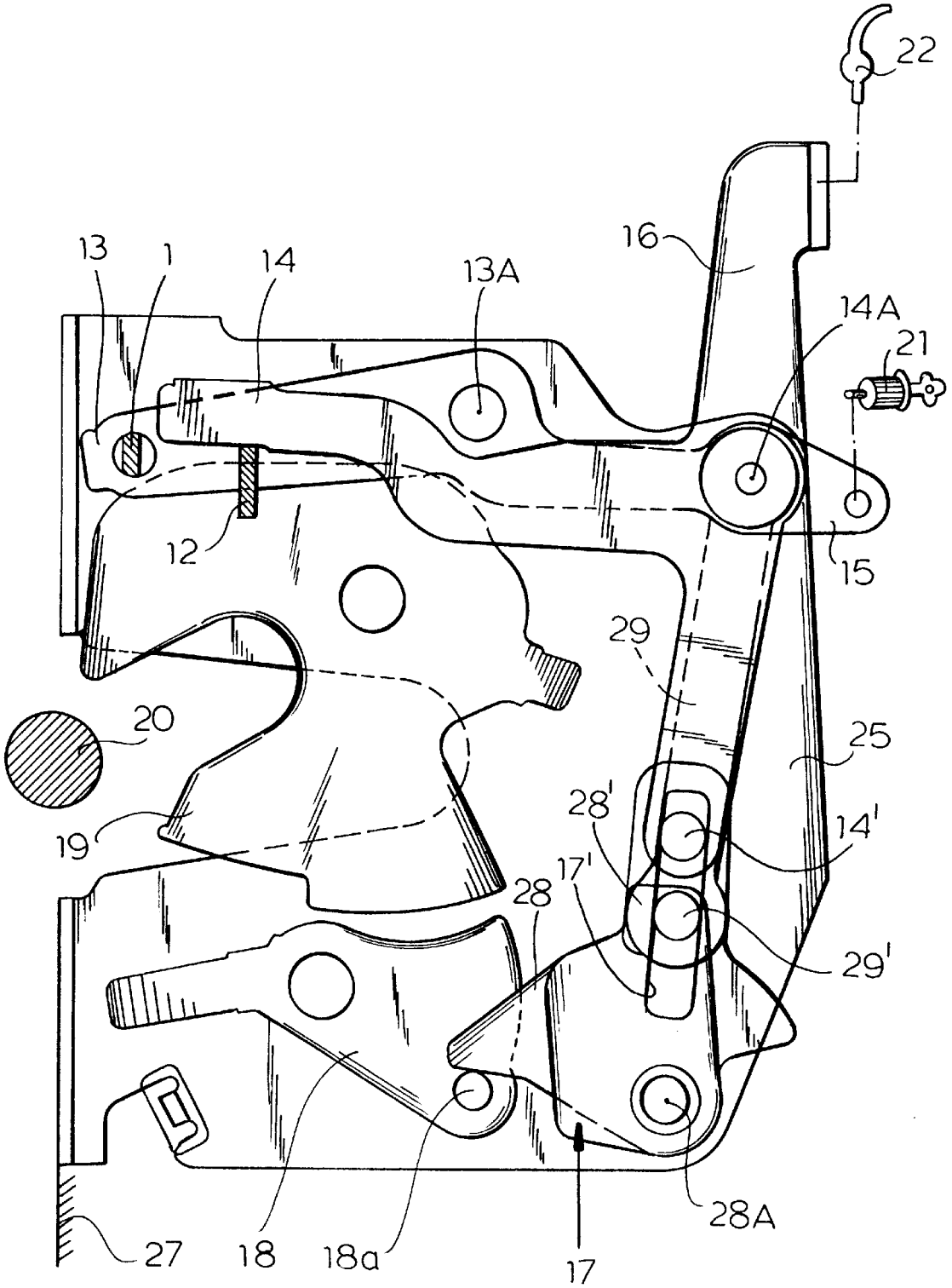
FIG. 3 is a section taken along line III—III of FIG. 1.

FIG. 3 shows the lock mechanism in somewhat greater detail. The housing 25 is mounted on an edge of a door illustrated schematically at 27 and formed with a main cutout in which a fork 19 is pivotal so as to trap and hold a bolt 20 extending from an unillustrated door post. A pawl 18 carrying an actuating pin 18*a* can secure the fork 19 in the illustrated holding position or can be pivoted to allow the fork 19 to pivot clockwise and release the bolt 20.

The housing 25 carries a release lever 28 pivotal about an axis 28A, a guide 17 also pivoted on this axis 28A, a lever 13 pivoted about another parallel axis 13A, a link 29 pivoted on an end of the lever 13, and an L-shaped lever 14 pivoted at an axis 14A on the housing 25. The lever 14 is acted on by a lever 12 intended to move the latch between the latched and unlatched positions, respectively retaining and releasing the bolt 20. The lever 13 is acted on a by the inside locking lever 1 that displaces it between the locked and unlocked positions. In the locked position, actuation of the lever 14 by the locking lever 1 is not effective to release the bolt. Virtually identical structure is shown and described in detail in copending application Ser. Nos. 08/184,247 now U.S. Pat. No. 5,476,294 and 08/184,250 now U.S. Pat. No. 5,494,322.

More specifically, the lower end of the link 29 carries a coupling part or pin 29' which slides in a slot 17' of the guide 17 and is engageable with an entrainment tab 28' of the lever 28. The lower end of the lever 14 carries a pin 14' which rides in the slot 17' above the pin 29'. Thus when the lever 13 is in the locked, the pin 29' is below the tab 28' and clockwise pivoting of the lever 14 will pivot the guide 17 and pin 29' counterclockwise, but since the pin 29' is below the tab 28', this pivoting will not be transmitted to the lever 28 and the lock will remain latched.

When, however, the lever 13 is pivoted somewhat counterclockwise into the unlocked position, the link 29 and pin 291 are raised, putting this pin 29' next to the tab 28'. Subsequent clockwise pivoting of the lever 14 will therefore move the pin 29' toward the left so that the lever 28 will act on the pin 18*a* and push the pawl 18 down, unlatching the latch and releasing the bolt 20.

We claim:

1. A motor-vehicle door latch comprising:

a housing;

a locking mechanism in the housing having an inside locking lever displaceable between a locked position in which the latch is in a locked condition and an unlocked position in which the latch is in an unlocked condition;

a generally cylindrical output element rotatable about and centered on an axis and formed with a radially outwardly open spiral main groove having a pair of ends and with an axially extending transverse connecting groove extending between the ends;

a pin mounted directly on the locking lever and riding directly in the spiral groove;

means including a reversible electric motor for rotating the output element so that the pin travels between the ends of the spiral groove for displacing the locking lever into the locked position when the pin engages one of the groove ends and for displacing the locking lever into the unlocked position when the pin engages the other of the groove ends; and means including a manually actuatable locking element connected directly to the inside locking lever for displacing same between its positions with movement of the pin along the connecting groove between the spiral groove ends.

* * * * *